US008475721B2

(12) United States Patent
Okabe

(10) Patent No.: US 8,475,721 B2
(45) **Date of Patent: *Jul. 2, 2013**

(54) HOLDING SEALER AND EXHAUST GAS PROCESSING DEVICE

(75) Inventor: Takahiko Okabe, Ogaki (JP)

(73) Assignee: Ibiden Co., Ltd., Ogaki-shi (JP)

( * ) Notice: Subject to any disclaimer, the term of this patent is extended or adjusted under 35 U.S.C. 154(b) by 1416 days.

This patent is subject to a terminal disclaimer.

(21) Appl. No.: 11/375,464

(22) Filed: Mar. 15, 2006

(65) Prior Publication Data

US 2007/0081926 A1 Apr. 12, 2007

(30) Foreign Application Priority Data

Oct. 7, 2005 (JP) ..... 2005-295527
Nov. 25, 2005 (JP) ..... 2005-340960

(51) Int. Cl.
*B01D 50/00* (2006.01)

(52) U.S. Cl.
USPC ..... 422/179

(58) Field of Classification Search
USPC ..... 422/168, 177, 179, 180
See application file for complete search history.

(56) References Cited

U.S. PATENT DOCUMENTS

| | | | | |
|---|---|---|---|---|
| 3,808,094 | A * | 4/1974 | Mcknight | 162/215 |
| 3,826,412 | A * | 7/1974 | Kneusel | 222/397 |
| 6,613,296 | B1 * | 9/2003 | Myers et al. | 422/179 |
| 6,660,359 | B1 | 12/2003 | Wirth et al. | |
| 6,967,006 | B1 * | 11/2005 | Wirth et al. | 422/179 |
| 7,033,412 | B2 * | 4/2006 | Kumar et al. | 55/523 |
| 2001/0048903 | A1 | 12/2001 | Sanocki et al. | |
| 2007/0160509 | A1 | 7/2007 | Saiki | |
| 2007/0212272 | A1 | 9/2007 | Okabe | |

FOREIGN PATENT DOCUMENTS

| | | | |
|---|---|---|---|
| EP | 0 824 184 | A2 | 2/1998 |
| FR | 2663961 | A1 * | 1/1992 |
| JP | 40-16231 | | 7/1965 |
| JP | 51-82306 | | 7/1976 |
| JP | 60-173151 | | 9/1985 |
| JP | 7-102961 | | 4/1995 |
| JP | 7-286514 | | 10/1995 |
| JP | 10-503557 | A | 3/1998 |
| JP | 11-50371 | | 2/1999 |
| JP | 2000-24437 | | 1/2000 |
| JP | 2005-54726 | | 3/2005 |
| JP | 2005-74243 | A | 3/2005 |
| WO | WO 96/03353 | A1 | 2/1996 |
| WO | WO 99/39086 | | 8/1999 |
| WO | WO 2004/061279 | A1 | 7/2004 |

OTHER PUBLICATIONS

Office Action issued Oct. 5, 2010, in Japanese Patent Application No. 2005-340960.

Office Action mailed Feb. 19, 2013 in Japanese Patent Application No. 2011-120153.

* cited by examiner

*Primary Examiner* — Tom Duong

(74) *Attorney, Agent, or Firm* — Oblon, Spivak, McClelland, Maier & Neustadt, L.L.P.

(57) ABSTRACT

A holding sealer for keeping a exhaust gas processing device, in which comprises a sheet member including inorganic fibers, the inorganic fibers are oriented in a predetermined angle except parallel against a direction of a thickness of a sheet member within at least a portion of the sheet member.

12 Claims, 5 Drawing Sheets

HOLDING SEALER AND EXHAUST GAS PROCESSING DEVICE

BACKGROUND OF THE INVENTION

1. Field of the Invention

This invention generally relates to a exhaust gas processing device of vehicles, and more particularly, to a holding sealer used for the exhaust gas processing device.

2. Description of the Related Art

The number of cars is greatly increasing since the beginning of this century, and the amount of exhaust gas from car's engine room have been increasing amazingly as increasing the number of cars. Especially, various materials in the exhaust gas from diesel engine trigger environmental pollution, so that these materials have been influencing seriously on global environment currently.

Under this circumstance, various exhaust gas processing devices have been suggested, and these have been used practically. Typical exhaust gas processing device has a casing (metallic shell) on a exhaust pipe connected to a exhaust gas manifold of the engine room, in which casing, a exhaust gas processing body having lots of small holes is arranged thereon. As an example of the exhaust gas processing body, there are a catalyst carrier and a diesel particulate filter (DPF). For example, in the case of DPF, particles are trapped by walls around holes during the exhaust gas passing through the exhaust gas processing body based on the above structure, thereby particles can be removed from the exhaust gas. Constitution materials of the exhaust gas processing body are metals, alloys, and ceramics, etc. As typical example of the exhaust gas processing body comprising ceramics, a honeycomb filter made by cordierite is known. Recently, from the viewpoint of the heat resistance, a mechanical strength, chemical stability and etc, a porous silundum sintering body is used as the exhaust gas processing body.

Usually, the holding sealer is placed between the above exhaust gas processing body and the metallic shell. The holding sealer is used for protecting a breakage due to a contact of the exhaust gas processing body with the metallic shell during vehicle runs, and for protecting a leakage of the exhaust gas from a gap between the metallic shell and the exhaust gas processing body. Also, the holding sealer plays an important role for preventing the exhaust gas processing body from falling off due to an exhaust pressure of the exhaust gas. Moreover, the exhaust gas processing body needs to keep high temperature for stabilizing the reaction, and also the holding sealer needs the heat resistance. As a constitutional member satisfying these requirements, there is a sheet member including inorganic fibers such as alumina system fiber, etc.

The sheet member has wound around at least a portion of an outer surface except an open surface of the exhaust gas processing body, and the sheet member functions as the holding sealer by fixing as one body with the exhaust gas processing body by means of taping. Then, the one whole body is assembled into the exhaust gas processing device by pressing into the metallic shell.

It is difficult to handle conventional sheet member because the usual sheet member is bulky and fibers are scattered during a cutting process. Therefore, several methods are proposed in order to improve the handling of the sheet member when used as the holding sealer of the exhaust gas processing device. For example, one method is suggested that the sheet member including inorganic fibers is processed as so-called needling process, inorganic fibers are inter-woven along with a direction of a thickness of the sheet member, the sheet member having a large amount of volume is compressed and is to be thinner. (For example, see JP-A 7-286514)

SUMMARY OF THE INVENTION

There is one aspect of the present invention, a holding sealer for holding a exhaust gas processing device, in which comprises a sheet member including inorganic fibers, the inorganic fibers are oriented in a predetermined angle except parallel against a direction of a thickness of a sheet member within at least a portion of the sheet member is provided.

Additionally, in the holding sealer according to the present invention, the oriented direction of the inorganic fibers may be existed locally within the sheet member. Also, the term "locally" means that the characteristics of oriented direction of the inorganic fibers are only existed locally within the sheet member and are existed periodically or at random in several places within the sheet member.

Additionally, in the holding sealer according to the present invention, the oriented direction of the inorganic fibers is formed by a needling process of the sheet member.

Additionally, in the holding sealer according to the present invention, it is preferable that the oriented angle of the inorganic fibers against the direction of the thickness of the sheet member is greater than 0° and below than or equal to about 85°. When the oriented angle is within this range, the better tensile strength against the winding direction of the holding sealer can be obtained. Especially, it is preferable that the oriented angle of inorganic fibers is between about 45° and 75°.

Additionally, in the holding sealer according to the present invention, the sheet member may comprise binder. Fibers are adhesively bonded more strongly due to the sheet member including binder, even more particularly, the handling as the holding sealer improves.

Additionally, in the holding sealer according to the present invention, the average diameter of the inorganic fibers may be greater than or equal to about 6 micro meters.

Additionally, in the holding sealer according to the present invention, it is preferable that the inorganic fibers are a mixture of alumina and silica.

There is also another aspect of the present invention, an exhaust gas processing device which comprises a metallic shell including an exhaust gas processing body and a holding sealer wound around at least portion of outer surfaces of the exhaust gas processing body, wherein the holding sealer comprises a sheet member including the inorganic fibers and the inorganic fibers are oriented in a predetermined angle except parallel against the direction of the thickness of the sheet member within at least a portion of the sheet member.

Additionally, in the exhaust gas processing device according to the present invention, the exhaust gas processing body may be a catalyst carrier or an exhaust gas filter.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Next, a description is given, with reference to the accompanying drawings, of an embodiment of the present invention.

In this invention, in the holding sealer which comprises the sheet member including inorganic fibers and holds the exhaust gas processing body, inorganic fibers are oriented with desired angle to the direction of the thickness of the sheet member except parallel direction within at least a portion of the sheet member.

Figure 1:
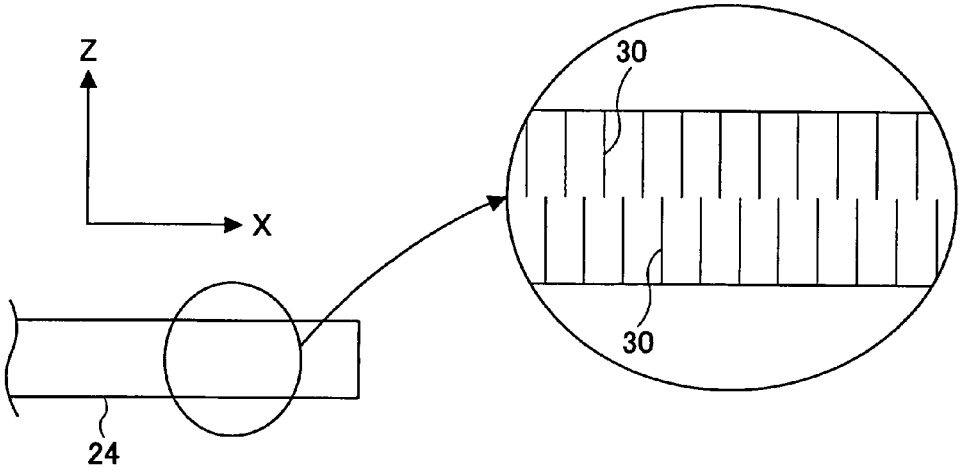
FIG. 1 is a cross-sectional enlarged view of a sheet member used for a conventional holding sealer.

In general, the sheet member used for the holding sealer of the exhaust gas processing device is composed with laminating multi-layers of sheets including inorganic fibers like alumina. The laminated sheet is bulky under laminated condition and it is easy to peel off between layers thereof. Usually, the laminated sheet is processed with so-called needling process after laminating process is finished. The needling process is that many needles are stabbed into the laminated sheet and pulled off needles from the laminated sheet, thereby allow each layer more close contact and allow the sheet to be thin. Generally, a needling machine is used for the needling process. The needling machine comprises a needle board movable to back and forth along a stabbing direction of needles, and a support plate which is provided on both side of the laminated sheet and fixes the laminated sheet. On the needle board, lots of needles for stabbing into the laminated sheet are arranged with perpendicular direction against a plane of the board about 100-5000 needles/100 $cm^2$, for example. Also, lots of through-holes for needles are provided on the support plate, thereby needles can be passed though these through-holes and reach the laminated sheet. Using such needling machine, by processing the needling process such that stabbing needles into the laminated sheet and pulled off needles from the laminated sheet, thereby fibers which intertwined with each other complicatedly are oriented along with the direction of the thickness and anti-peeling characteristic for the direction of the thickness of the laminated sheet can be improved. In addition, as shown in FIG. 1, it is confirmed that many needling processed traces 30 are formed with almost parallel to the laminating direction (Z direction in FIG. 1) on the sheet member 24 and lots of fibers are oriented along with these traces when a cross-section of the sheet member comprising the laminated sheet obtained with the above process is observed.

Figure 2:
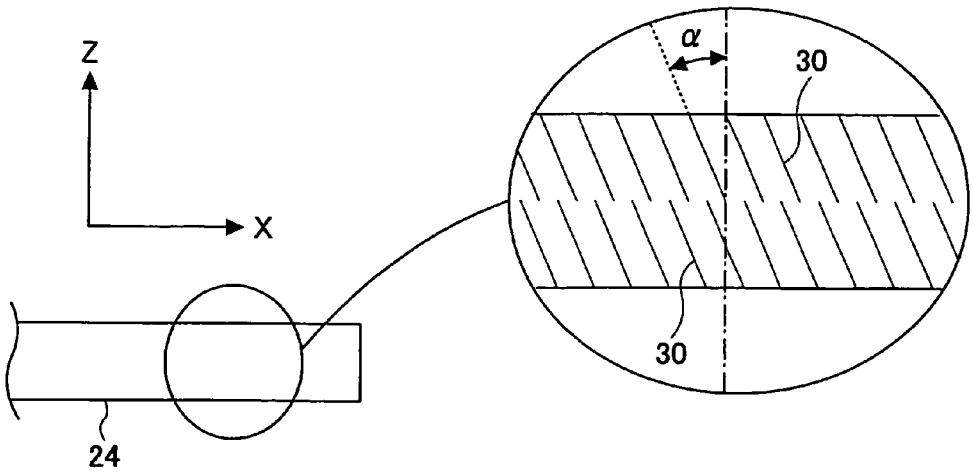
FIG. 2 is a cross-sectional enlarged view of the sheet member used for the holding sealer of the present invention.

In contrast, for the sheet member 24 used for the holding sealer of the present invention, it is characterized that inorganic fibers are oriented to make certain oriented angle $\alpha$ against the direction of the thickness of the sheet member (see FIG. 2).

Accordingly, in the sheet member 24 in which fibers have certain oriented angle $\alpha$ against the direction of the thickness of the sheet member, a strength against the tensile stress of the perpendicular direction (X direction in FIGS. 1 and 2) to the direction of the thickness become more strong compared to the sheet member which conventional fibers are oriented with parallel to the direction of the thickness ($\alpha$=0°). Thus, in the case that such sheet member 24 is used as the holding sealer of the exhaust gas processing device, when the holding sealer is fixed to the exhaust gas processing body by winding around the exhaust gas processing body so that certain tension along the winding direction occurs, cracks and breaks in the holding sealer can be avoided. Especially, considering to environment, it is expected that average fiber diameter of fibers of the sheet member 24 is increasing, for example, the current size of less than 6 micro meters will be changed to the future size, which greater than or equal to 6 micro meters. In general, when average fiber diameter of fibers included in the sheet member is increased, tiny gaps to occur around fibers increase, and the regions where fibers intertwine with each other decrease, therefore, the tensile strength of the perpendicular direction against the direction of the thickness of the sheet member tends to become weak. In such a case, however, the tensile strength of the perpendicular direction against the direction of the thickness is strong in the holding sealer of the present invention, it is enough applicable against increasing the average fiber diameter of the sheet member 24 in the future.

The sheet member having the above fiber orientation can be obtained such that needles are fixed to the needle board so as to have a desired incline against the board plane, and the needling process is performed with the above needle board, for example. In FIG. 2, conceptual cross-sectional view of the sheet member 24 used for the holding sealer of the present invention is shown. As shown in FIG. 2, lots of needling process traces 30 having desired (correspond to fixed angle of needles fixed on the above needle board) oriented angle $\alpha$ against the direction of the thickness are formed inside the she member, thereby it is recognized that many fibers are oriented along with these traces.

Especially, it is preferable that the oriented angle $\alpha$ (angle of fibers oriented against the direction of the thickness (Z direction) of the sheet) of fibers included in the sheet member 24 is greater than 0° and less than or equal to about 85° and more preferably, the angle is between about 45° and 75°. This is because the sheet member gains very large effect of the tensile strength when the oriented angle of fibers is greater than or equal to about 45°. Also, in the case of that the oriented angle of fibers is less than or equal to about 75° the amount of fibers receiving damages by means of needles does not increase during needling process when the sheet member having the oriented angle $\alpha$ of fibers is manufactured by the needling process. Thus, the tensile strength of the sheet member for the direction which is perpendicular to the direction of the thickness will not be decreased.

Also, it is preferable that binder is impregnated in the sheet member 24 after the needling process. Because the sheet member 24 includes binder, a bulkiness of the sheet member 24 can be limited, fibers get together and it is bound tightly strongly. Thus, a scattering of fibers can be prevented, when the sheet member 24 is processed for cutting, or when the sheet member 24 is wound around the exhaust gas processing body or when the sheet member 24 is sealed into the metallic shell 12 as the holding sealer 15 shown in FIG. 4. Also, when hot exhaust gas is introduced into the exhaust gas processing device 10 including the holding sealer 15, organic binders of the holding sealer 15 are disappeared, thereby the compressed holding sealer 15 is restored, tiny gaps which might be existed between the metallic shell 12 and the exhaust gas processing body 20 are sealed up, thus, a retentivity and a seal ability of the holding sealer 15 are improved. As binder, organic binder or inorganic binder can be used. As organic binder, epoxy resin, acryl resin, rubber resin, styrenic resin and others can be used. As inorganic binder, silica sol, alumina sol and others can be used.

Figure 3:
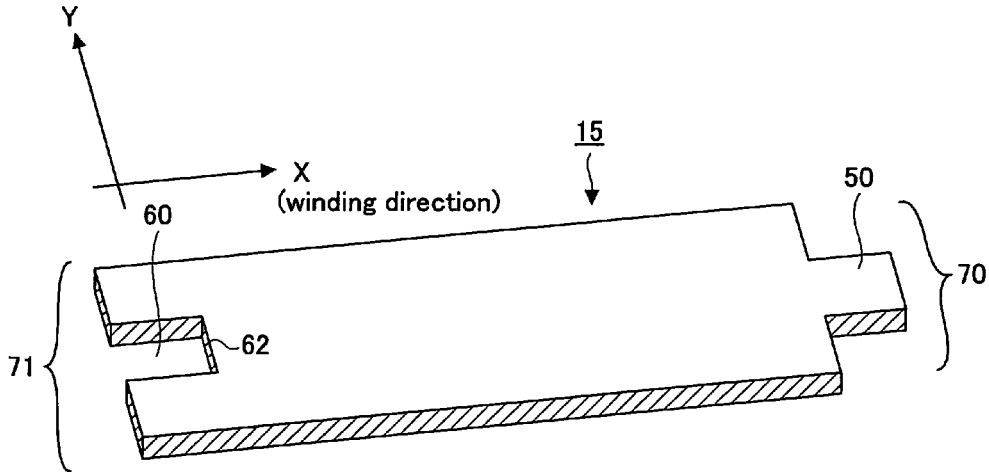
FIG. 3 is an example of a structure of the holding sealer of the present invention.
Figure 4:
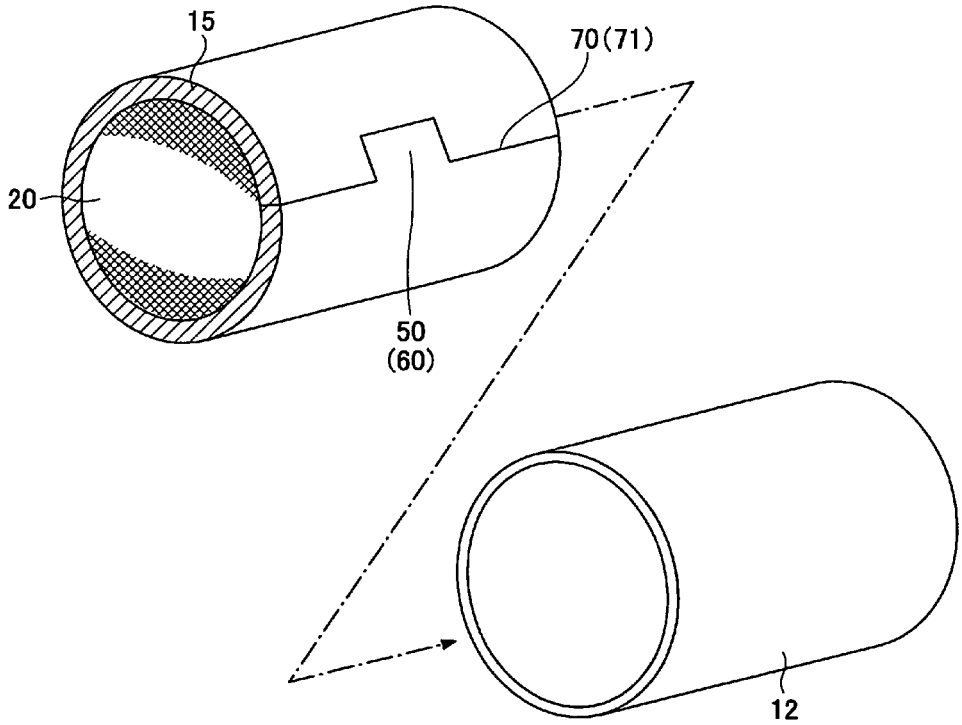
FIG. 4 is a conceptual view of a structure of the exhaust gas processing device, in which the holding sealer of the present invention is wound around the exhaust gas processing body and fixed thereto and then pressed into a metallic shell.

The sheet member 24 which manufactured in the above method can be used as the holding sealer 15 which wound around and fixed to the outer surface of the exhaust gas processing body 20. One example of structures of the holding sealer 15 is shown in FIG. 3, but the structure of the holding sealer 15 of the present invention is not limited to FIG. 3. In FIG. 3, the holding sealer 15 has a pair of fitting salient 50 and fitting reentrant 60 at both edges 70, 71 which are perpendicular to the winding direction (X direction). When the holding sealer 15 is wound around the exhaust gas processing body 20, the fitting salient 50 and the fitting reentrant 60 are fitted together as shown in FIG. 4, then the holding sealer 15 is fixed to the exhaust gas processing body 20. Here, the holding sealer 15 of the present invention has strong tensile strength against the direction which is perpendicular to the direction of the thickness of the sheet member 24, as described above. Thus, when the holding sealer 15 is wound around the exhaust gas processing body 20, cracks and breaks are hard to occur on the holding sealer 15 even if tensile stress is applied to the winding direction (X direction), thereby the above-mentioned problem can be avoided. The exhaust gas processing body 20 in which the holding sealer 15 is wound around is installed into the metallic shell 12 by a press-fit means, for example, as shown in FIG. 4.

Figure 5:
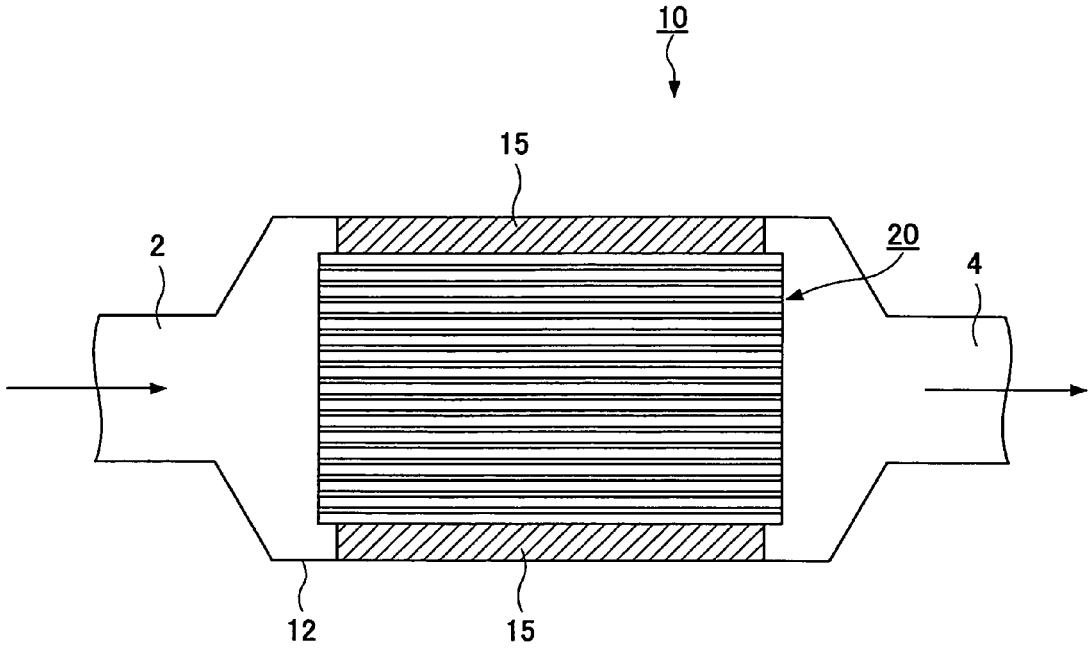
FIG. 5 is an example of a structure of the exhaust gas processing device of the present invention.

One example of structures of the exhaust gas processing device 10 manufactured with the above method is shown in FIG. 5. In this example of FIG. 5, the exhaust gas processing body 20 is a catalyst carrier having lots of through-holes in a direction parallel to gas flow. For example, the catalyst carrier comprises honeycomb-shaped porous silundum. Also, the exhaust gas processing device 10 of the present invention are not limited in such a structure. For example, it is possible that the exhaust gas processing body 20 may be a DPF, in which a part of through-hole is sealed.

One example of manufacturing method of the holding sealer 15 of the present invention will be explained in the below.

The holding sealer 15 of the present invention comprises the sheet member 24, and the sheet member 24 is manufactured as follows.

First, a precursor comprising inorganic fibers is manufactured. In the below description, a mixture of alumina and silica as inorganic fibers can be used, but inorganic fibers are not limited to the above mixture. For example, either only alumina or silica may be used for its structure of inorganic fiber. In one example, silica sol is added to basic aluminum chloride solution (about 70 g/l of aluminum, Al:Cl=1.8 (atomic ratio)) so as to about 60-80:about 40-20 of alumina: silica ratio, thereby the precursor of inorganic fibers is prepared. If alumina ratio is below than 60%, an existence ratio of mullite produced from alumina and silica become low, thereby thermal conductivity of the sheet member 24 increases and enough heat insulation can not be achieved. Especially, it is preferable that alumina:silica ratio is about 70-74:about 30-26.

Next, organic polymers such as polyvinyl alcohols are added to the precursor of alumina fibers. Then, this liquid is condensed and a spinning solution is prepared. Also, the spinning is processed with a blowing method by using the spinning solution.

The blowing method is a method for spinning by using an air flow blowing from an air nozzle and a flow of the spinning solution pushed out from a supply nozzle of the spinning solution. Gas speed per slit from the air nozzle is usually about 40-200 m/s. Also, diameter of a spinning nozzle is usually 0.1-0.5 mm. The amount of solution per one supply nozzle of the spinning solution is usually 1-120 ml/h, but 3-50 ml/h is preferable. In such a condition, the spinning solution pushed out from a supply nozzle of the spinning solution does not become form of spray (form of fog) but spread enough, and it is hard to be welded between fibers. Because of this, even precursor of alumina fiber which a distribution of diameter of fiber is narrow can be obtained by optimizing the spinning condition.

Here, average length of fibers of alumina fibers manufactured is longer than or equal to about 250 micro meters, preferably. More preferably, it is longer than or equal to 500 micro meters. If the average length of fibers is longer than or equal to about 250 micro meters, fibers are intertwined each other enough and enough strength is provided. Also, especially, the average diameter of fibers of inorganic fibers is not limited. However, it is noted that the present invention has its effect even if the average diameter of fibers of inorganic fibers is longer than or equal to about 6 micro meters, as described below.

The sheet member is manufactured by laminating the precursor which spinning is completed. Also, the needling process is performed against the sheet member using the needling machine. Here, in the needle board of the present invention, needles are fixed so as to have a predetermined angle of leaning against the plane face of the needle board. Thus, the sheet member which fibers are not paralleled against the direction of the thickness of the sheet but oriented direction with predetermined angle can be obtained by performing the needle process using the needle board.

Then, the sheet member with the specific needling process is heated from ambient temperature, and the predetermined concentration of sheet member 24 can be obtained by continuous firing around the hottest temperature, 1250° C.

In order to handle easily, the sheet member 24 which is obtained with the above process is cut into predetermined size.

Then, organic binders like resin are impregnated in the sheet member 24 which is cut, as necessary. It is preferable that the content of organic binder is between about 1.0 and 10.0 weight %. If the content is less than 1.0 weight %, the secession of inorganic fiber cannot be prevented enough. Also, if the content is greater than 10.0 weight %, the sheet member cannot be flexible and it is difficult that the sheet member 24 is wound around the exhaust gas processing body 20.

Also, it is preferable to use acrylic resin (ACM), acrylnitryl-butadiene gum (NBR), stylene-butadiene gum (SBR) as organic binders.

The resin is impregnated in the sheet member 24 by spray coating using aqueous dispersion prepared with the above organic binders and water. Also, any excess coated solid and water included in the sheet member 24 are removed in the next step.

In next step, any excess solid is removed and a drying process is performed. Removing of the excess solid is processed by vacuum aspiration. Also, removing of the excess water is processed by heat compression drying method. In this method, because a pressing pressure is applied to the sheet member, the excess water can be removed and the sheet member can be thinned. The drying process is performed around about 95-155° C. If the temperature is higher than about 95° C., the drying time will not take more long time and production efficiency will not decrease. Also, if the drying temperature is less than or equal to about 155° C., decomposition of organic binder themselves will not begin to start and adhesive performance due to organic binder will not be lost.

Finally, a predetermined form of the sheet member 24 can be obtained.

Accordingly, alumina fibers are included and organic binders are impregnated in the sheet member 24, also the sheet member 24 which the oriented arranged of fibers is controlled can be obtained.

Also, it is not limited that the present invention is applied to methods to obtain a laminated sheet by laminating the above precursors of inorganic fibers. For example, as inorganic fibers included in the sheet member, when materials having relatively low melting point such as glass are used, the sheet member may be manufactured by so-called a melt blowing method. The melt blowing method is a method that a melt body of inorganic member is blown off using fluid with high speed directly and the sheet member is manufactured. Also, as another method for manufacturing the sheet member, so-called a paper scooping method may be used. This method is a method that slurry of inorganic fibers is poured into a paper scooping mold which tiny pores are opened in the bottom, and the sheet member is obtained by applying absorption dehydration to the paper scooping mold. For the sheet member obtained by these methods, the sheet member which inorganic fibers is oriented in direction of predetermined angle against the direction of the thickness of the sheet is obtained by performing the above mentioned needling process, thus, the tensile strength of the sheet member can be improved.

In the below, effects of the present invention will be explained using embodiments.

Embodiments

The sheet member is manufactured by following procedures.

Manufacturing of the Sheet Member

The silica sol was blended to basic aluminum chloride solution (aluminum content: 70 g/l, Al/Cl=1.8 (atomic ratio)) so as to be $Al_2O_3$:$SiO_2$=72:28 in composition of alumina fibers, then the precursors of alumina fibers were formed.

Then, organic copolymers like polyvinyl alcohol were added to the precursor of alumina fibers. Also, the solution was diluted to be as the spinning solution, the spinning was performed with the blowing method using the spinning solution.

Then, folded structures of the precursor of alumina fibers were laminated, and the laminated sheet of alumina fibers was manufactured. The needling process was performed against the laminated sheet using the needle board having needles of 500/100 $cm^2$. Fixed angles of needles were 50 against perpendicular direction to the board plane. Thus, the sheet member which the oriented angle of fibers $\alpha$ is almost 5° was obtained after needling process.

Then, the obtained sheet member was continuous firing from the ambient temperature to the hottest temperature 1250° C., then the sheet member of alumina fibers having 1160 g/$cm^2$ of concentration is obtained. The average fiber diameter of alumina fibers was 5.0 micro meters and minimum diameter was 3.2 micro meters. Also, the thickness of the sheet member was 9 mm.

Also, the average diameter of fibers is measured as the following method. First, alumina fibers were put into a cylinder, a pressure crush process was applied at 20.6 Mpa. Then, these samples were put on a filter net, and samples which passed through the filter net were assumed an examination body for electron microscopic observation. After gold is evaporated on a surface of the examination body, electron microscopic pictures (almost 1500×) were taken. The diameter of fibers is measured for at least 40 fibers based on the obtained pictures. This step is repeated for 5 samples and average measured value was the average diameter of fibers.

Cutting of the Sheet Member

The sheet member manufactured based on the above step was cut into a size of 1270 mm vertical length and 1280 mm horizontal length.

Impregnating of Organic Binder

The organic binder was impregnated into the sheet member which was cut. Acryl resin aqueous dispersion (Nippon Zeon: LX803; solid concentration 50±10%, pH5.5-7.0) was prepared so as to be 1.0-10.0 wt % of resin concentration, then an impregnating solution is obtained. Then, the impregnating solution was impregnated to the sheet member by spray coating.

Absorption of the Solid

An excess solid over the predetermined amount is adhered to the sheet member after impregnating aluminum binder, the excess solid was removed by adsorption process (almost 3 seconds) of the solid. After this processing, an impregnated ratio of the organic binder of the sheet was 10 wt % as the result of weighting method.

Heat Compression Drying Method

The heat compression drying method is performed at 95-155° C. of drying temperature using the sheet member after absorption step. The average thickness of the final sheet member was about 8 mm. The sheet member obtained via the above step is the embodiment 1.

Then, sheet members of embodiments 2-7 and comparative embodiment 1 were manufactured using same process as well as the above step, except changing the angle of needles fixed on needle board used for the needling process to 0-85°. Thus, for these embodiments and comparative embodiment, the oriented angle $\alpha$ of fibers in the sheet member is different from that of embodiment 1, but rest of manufacturing conditions are same as that of the sheet member of the embodiment 1.

TABLE 1

| | fiber diameter (μm) | oriented angle α (°) | pulling strength (N/25 mm width) |
|---|---|---|---|
| embodiment 1 | 5.0 | 5 | 67.9 |
| embodiment 2 | 5.0 | 15 | 70.4 |
| embodiment 3 | 5.0 | 30 | 74.9 |
| embodiment 4 | 5.0 | 45 | 84.6 |
| embodiment 5 | 5.0 | 60 | 83.3 |
| embodiment 6 | 5.0 | 75 | 82.8 |
| embodiment 7 | 5.0 | 85 | 75.6 |
| embodiment 8 | 5.8 | 5 | 66.0 |
| embodiment 9 | 5.8 | 15 | 68.3 |
| embodiment 10 | 5.8 | 30 | 73.0 |
| embodiment 11 | 5.8 | 45 | 82.3 |
| embodiment 12 | 5.8 | 60 | 81.1 |
| embodiment 13 | 5.8 | 75 | 80.0 |
| embodiment 14 | 5.8 | 85 | 73.5 |
| embodiment 15 | 7.2 | 5 | 43.1 |
| embodiment 16 | 7.2 | 15 | 45.2 |
| embodiment 17 | 7.2 | 30 | 48.8 |
| embodiment 18 | 7.2 | 45 | 56.0 |
| embodiment 19 | 7.2 | 60 | 58.0 |
| embodiment 20 | 7.2 | 75 | 59.7 |
| embodiment 21 | 7.2 | 85 | 50.1 |
| comparative embodiment 1 | 5.0 | 0 | 65.2 |
| comparative embodiment 2 | 5.8 | 0 | 63.8 |
| comparative embodiment 3 | 7.2 | 0 | 33.3 |

Also, sheet members of embodiments 8-14 and comparative embodiment 2 were manufactured using same process as well as the above step, except changing for that the average diameter of fibers of alumina fibers is 5.8 micro meters and the fixed angle of needles is 0-85° for manufacturing the above sheet member. Also, the oriented angle α of inorganic fibers of these sheet members are shown in FIG. 1.

Also, sheet members of embodiments 15-21 and comparative embodiment 3 were manufactured using same process as well as the above step, except changing for that the average diameter of fibers of alumina fibers is 7.2 micro meters and the fixed angle of needles is 0-85° for manufacturing the above sheet member. Also, the oriented angle α of inorganic fibers of these sheet members are shown in FIG. 1.

Then, the tensile examination was performed using samples which the obtained sheet members were cut into the predetermined shape. In the below, examination results will be explained.

Results of Tensile Examinations

For tensile examinations, cut pieces of 150×50 mm of sheet members of embodiments 1-21 and comparative embodiments 1-3 manufactured in the above method were used as samples. A universal test machine (Instron) was used in these examinations, and the examination was started at the condition which both edges of short sides of the sample are fixed such that a fixed direction between edges is 50 mm. In the examination, one edge is pulled with a speed of 10 mm/min from the above condition, and a strength which the sample is broken (in the below, it is called pull strength) is measured.

Figure 6:
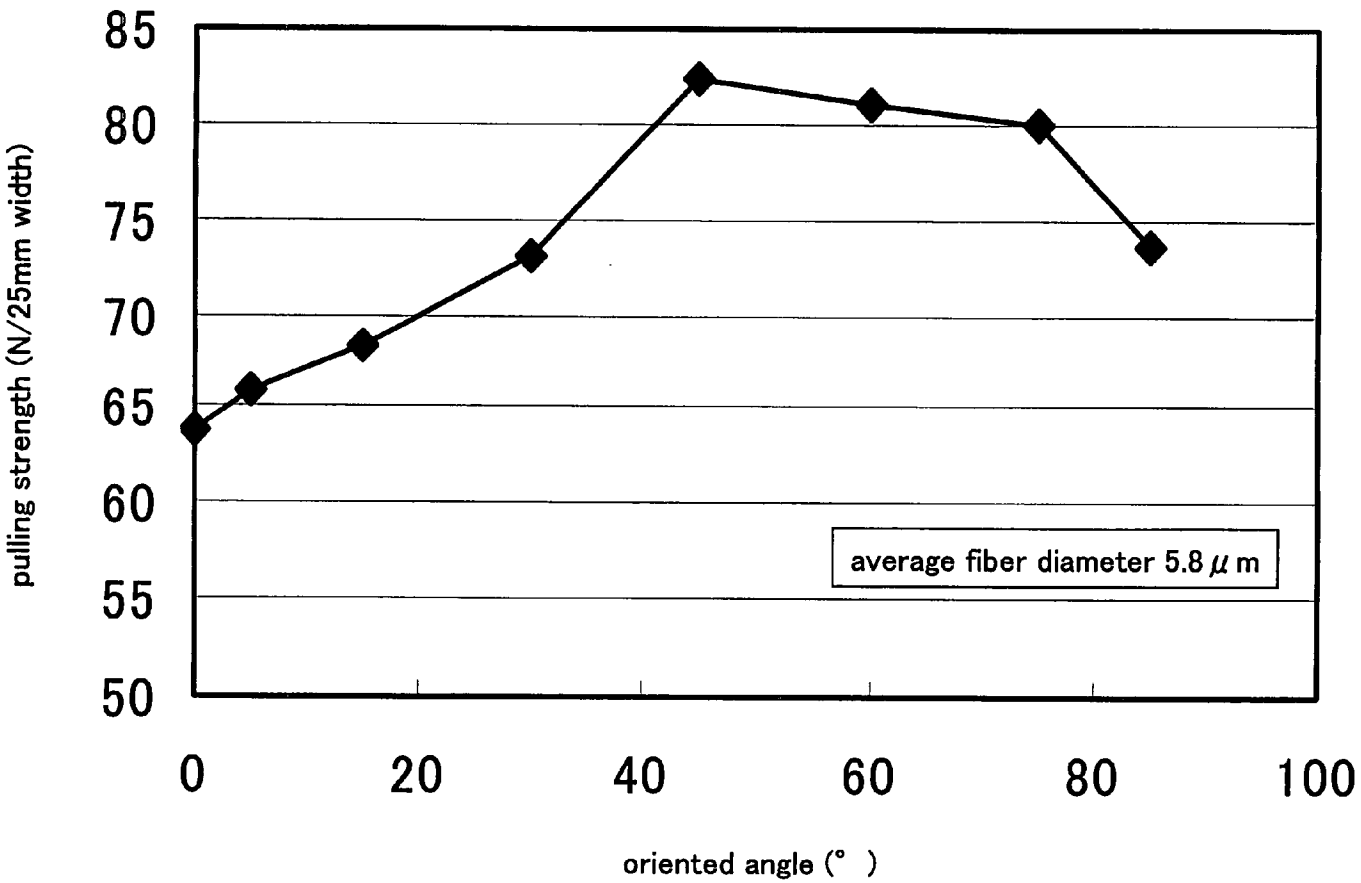
FIG. 6 is an illustration showing a relationship between an oriented angle of fiber and a tensile strength for a sheet member having 5.8 micro meters of an average particle diameter of the inorganic fibers.

The results are shown in FIG. 1. A change of the tensile strength against the oriented angle α of fibers for the sheet member having 5.8 micro meters of average particle diameter of inorganic fibers is shown in FIG. 6. Based on the results, when fibers has a predetermined oriented angle α against the direction of the thickness of the sheet member (in the case of embodiments 8-14), it is recognized that the tensile strength of the sheet member is increased compared to the sheet member (in the case of the comparative embodiment 2) which fibers are oriented in parallel against the direction of the thickness. Especially, the oriented angle α of inorganic fibers included in the sheet member is greater than or equal to 45° and less than or equal to 75°, the tensile strength is almost 25% greater than the sheet member which fibers are oriented in the direction of the thickness. In the FIG. 6, the tensile strength is increasing gradually as the oriented angle α is increasing within the extent which α is greater than 0 and less than or equal to 45°. However, the tensile strength tends to decrease as the oriented angle α is more increased. It is thought that an improved effect of the strength due to the increasing of the oriented angle α of fibers is offset by the influence of decreased strength of damages of fibers. That is, when the oriented angle α of fibers is increased, a needle distance which stuck in the sheet needs to be long in order to reach needles to certain depth against the direction of the thickness of the sheet. In this case, fibers in the sheet get damaged more frequently by stacking needles, thus the strength of fiber itself is decreased. Accordingly, it is thought that when the oriented angle α of fibers is over 45°, the improved effect of the strength of the sheet member due to the oriented direction can not be recognized. Also, a relationship between the oriented angle α and the tensile strength in FIG. 6 is recognized same as when average fiber diameter of inorganic fibers are 5.0 micro meters and 7.2 micro meters.

Figure 7:
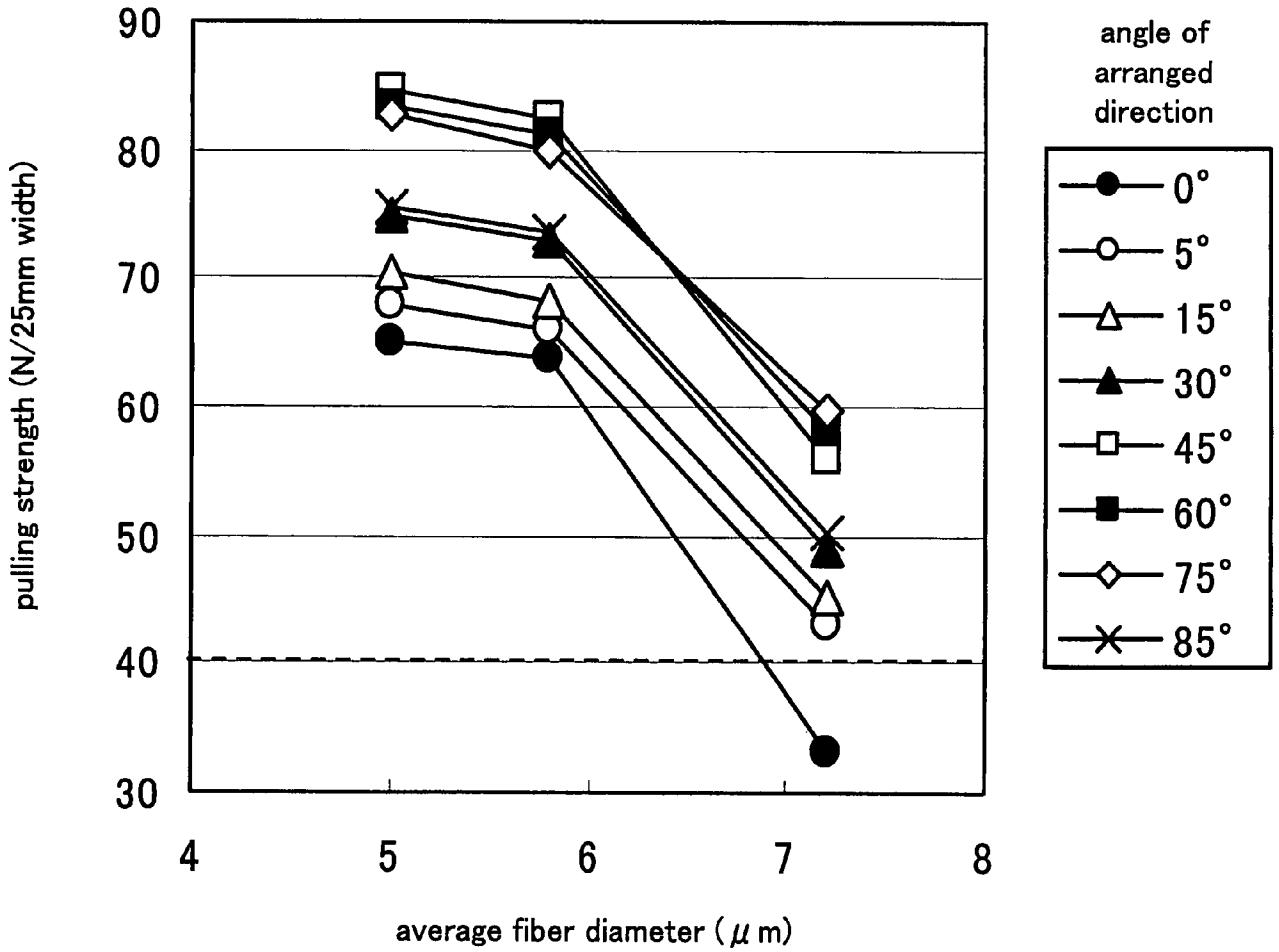
FIG. 7 is an illustration showing a relationship between an average fiber diameter and a tensile strength for each oriented angle of the inorganic fibers in the sheet member.

In FIG. 7, a relationship between the average fiber diameter and the tensile strength for each oriented angle α of inorganic fibers is shown. Because of the above reason, as the average fiber diameter of inorganic fibers in the sheet member is increased, the tensile strength tends to be decreased, in general. According to previous experiences and results of embodiments, if the tensile strength of the sheet member is over than 40N/(25 mm width), when the sheet member is used as the holding sealer of the exhaust gas processing device, it is reported that cracks and breaks are hard to occur in the holding sealer, the handling of the holding sealer is good enough in the case of winding the holding sealer around the exhaust gas processing device. When the average fiber diameter is below than 5.8 micro meter, the tensile strength is over than 40N/(25 mm width) even though the oriented angle α of fibers in the sheet member is 0°. However, when the average fiber diameter is over than 5.8 micro meter, the tensile strength of the sheet member which fiber is oriented in the direction of the thickness of the sheet (the sheet member which the oriented angle α is 0°) is below than 40N/(25 mm width). On the other hand, in the sheet member which the oriented angle α of fibers is over than 0°, the tensile strength is over than 40N/(25 mm×25 mm) even though the average fiber diameter of the sheet member is 7.2 micro meters. Thus, the sheet member which fibers are oriented in different angle from the direction of the thickness of the sheet is applicable as the holding sealer even though the average fiber diameter is increased over than 6 micro meters.

The holding sealer and the exhaust gas processing device of the present invention are applicable to the exhaust gas purifying device for vehicles.

The present invention is not limited to the specifically disclosed embodiment, and variations and modifications may be made without departing from the scope of the present invention.

The present application is based on Japanese priority application No. 2005-295527 filed on Oct. 7, 2005 and No. 2005-340960 filed on Nov. 25, 2005, the entire contents of which are hereby incorporated by references.

What is claimed is:

1. A holding sealer for holding an exhaust gas processing device, comprising:

a sheet member including interwoven inorganic fibers and having an upper side and a lower side, a plurality of discrete needling process traces existing in both of the upper and lower sides of the sheet member and being alternately arranged between the upper side and the lower side of the sheet member, each needling process trace being oriented in a predetermined angle between 5° and 85° with respect to a direction of a thickness of the sheet member, wherein the interwoven inorganic fibers are locally oriented in the predetermined angle along the needling process traces included within the sheet member and the oriented angle of the inorganic fibers with respect to the direction of the thickness of the sheet member is between about 45° and 75°.

2. The holding sealer as claimed in claim 1, wherein the sheet member comprises a binder material.

3. The holding sealer as claimed in claim 2, wherein an average diameter of the inorganic fibers is greater than or equal to about 6 micro meters.

4. The holding sealer as claimed in claim 1, wherein an average diameter of the inorganic fibers is greater than or equal to about 6 micro meters.

5. The holding sealer as claimed in claim 4, wherein the inorganic fibers is a mixture of alumina and silica.

6. The holding sealer as claimed in claim 1, wherein the inorganic fibers is a mixture of alumina and silica.

7. The holding sealer as claimed in claim 6, wherein the sheet member comprises a binder material.

8. The holding sealer as claimed in claim 7, wherein an average diameter of the inorganic fibers is greater than or equal to about 6 micro meters.

9. An exhaust gas processing device comprising:

a metallic shell including an exhaust gas processing body and a holding sealer wound around at least a portion of outer surfaces of the exhaust gas processing body, wherein the holding sealer comprises:

a sheet member including interwoven inorganic fibers and having an upper side and a lower side, and a plurality of discrete needling process traces existing in both of the upper and lower sides of the sheet member and being oriented in a predetermined angle between 5° and 85° with respect to a direction of a thickness of the sheet member, wherein the interwoven inorganic fibers are locally oriented in the predetermined angle along the needling process traces included within the sheet member and alternately arranged between the upper side and the lower side of the sheet member and the oriented angle of the inorganic fibers with respect to the direction of the thickness of the sheet member is between about 45° and 75°.

10. The exhaust gas processing device as claimed in claim 9, wherein the exhaust gas processing body is a catalyst carrier or an exhaust gas filter.

11. The device as claimed in claim 9, wherein the sheet member comprises a binder material.

12. The device as claimed in claim 9, wherein an average diameter of the inorganic fibers is greater than or equal to about 6 micro meters.

* * * * *